US006108996A

United States Patent [19]

McGinnis

[11] Patent Number: 6,108,996

[45] Date of Patent: Aug. 29, 2000

[54] APPARATUS AND METHOD FOR RETROFITTING TOWERS EXCHANGER

[76] Inventor: Henry J. McGinnis, 7241 Martha La., Fort Worth, Tex. 76112

[21] Appl. No.: 09/089,616

[22] Filed: Jun. 3, 1998

Related U.S. Application Data

[60] Provisional application No. 60/050,428, Jun. 5, 1997.

[51] Int. Cl.[7] ..... E04H 12/00

[52] U.S. Cl. ..... 52/651.02; 52/651.01; 52/651.03; 52/651.07; 52/651.09; 52/651.1; 52/652.1; 52/745.04; 52/745.18; 52/152

[58] Field of Search ..... 52/651.01, 651.02, 52/651.07, 651.1, 652.1, 652.2, 745.04, 745.18, 148, 294, 296, 297, 651.09, 651.03, 152

[56] References Cited

U.S. PATENT DOCUMENTS

| | | | |
|---|---|---|---|
| 919,771 | 4/1909 | Roberts | 52/152 |
| 1,105,777 | 8/1914 | Haskell | 52/651.03 |
| 1,906,634 | 5/1933 | Leake | 52/152 |
| 2,145,232 | 1/1939 | Bauer | 189/41 |
| 5,355,642 | 10/1994 | Palamarz | 52/73 |

*Primary Examiner*—Carl D. Freidman
*Assistant Examiner*—Nkeisha J. Maddox
*Attorney, Agent, or Firm*—James E. Bradley

[57] ABSTRACT

An existing tower has a set of legs and a large number of lacings which secure the legs to one another. An augmentation tower is located concentrically outside of the existing tower and also has a set of legs and lacings for joining its legs together. Each of the towers has its own foundation. Each of the legs of the augmentation tower is made up of a number of sections which are spliced together. Braces are spaced apart along the lengths of the legs and are used to fasten the two sets of legs together. After installation, both the existing and augmentation towers are maintained in upright positions with a single set of high-tension guy wires which are connected to the legs of the augmentation tower. The augmentation tower is installed on the existing tower like an exoskeleton and is installed in sections from the bottom of the existing tower upward. The operation of the tower is not impaired during installation.

21 Claims, 4 Drawing Sheets

APPARATUS AND METHOD FOR RETROFITTING TOWERS EXCHANGER

This application claims benefit of Provisional Appl. No. 60/050,428 filed Jun. 5, 1997.

TECHNICAL FIELD

This invention relates in general to towers and in particular to reinforcing existing communications towers.

BACKGROUND OF THE INVENTION

Some existing towers, such as guy-wired towers for supporting communications antennas, may weaken structurally over time or be incapable of supporting a desired load. In such cases, the tower usually must be replaced. A cost-effective alternative to replacing the tower, such as reinforcing the existing structure, preferably without interrupting the operation of the tower and antennas, is needed.

SUMMARY OF THE INVENTION

An existing tower has a set of legs and a large number of lacings which secure the legs to one another. An augmentation tower is located concentrically outside of the existing tower and also has a set of legs and lacings for joining its legs together. Each of the towers has its own foundation. Each of the legs of the augmentation tower is made up of a number of sections which are spliced together. Braces are spaced apart along the lengths of the legs and are used to fasten the two sets of legs together. After installation, both the existing and augmentation towers are maintained in upright positions with a single set of high-tension guy wires which are connected to the legs of the augmentation tower. The augmentation tower is installed on the existing tower like an exoskeleton and is installed in sections from the bottom of the existing tower upward. The operation of the tower is not impaired during installation.

BEST MODE FOR CARRYING OUT THE INVENTION

Figure 1:
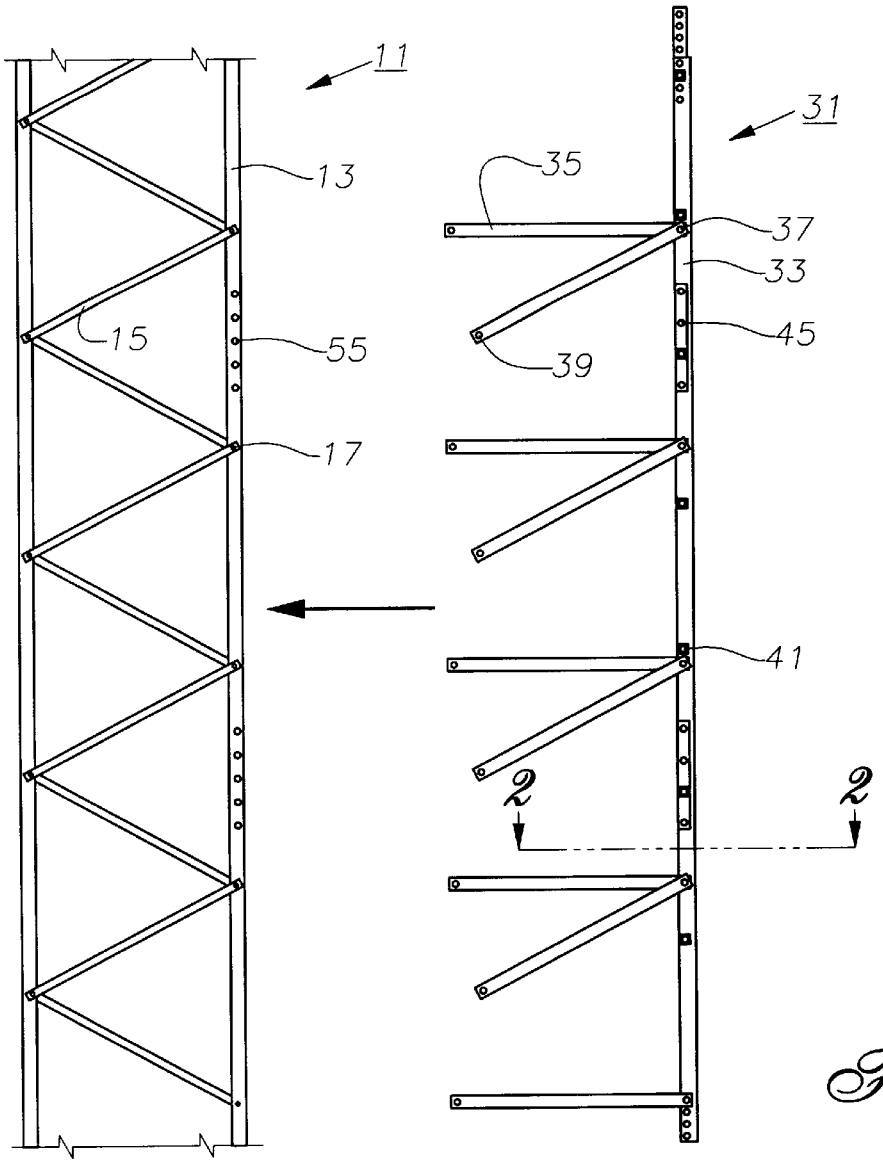
FIG. 1 is an exploded partial side view of an existing communication tower prior to the installation of a first embodiment of an augmentation tower constructed in accordance with the invention.

Referring to FIG. 1, an existing guyed steel communication tower 11 having an equilateral triangular cross-sectional pattern is shown. Existing tower 11 has three V-shaped legs 13 (two are shown) and a plurality of lacings 15 which secure legs 13 to one another. In some embodiments, legs 13 are parallel. Lacings 15 are fastened to legs 13 with bolts 17 which extend through holes in legs 13 and each end of lacings 15. Legs 13 and lacings 15 may be configured in many different patterns (not shown). Existing tower 11 supports a plurality of communication antennas (not shown) at an upper end.

In FIG. 1, existing tower 11 is shown prior to the installation of a first embodiment of an augmentation tower 31. Like existing tower 11, augmentation tower 11 has three legs 33 (one shown) and a plurality of lacings 35 for joining legs 33. Lacings 35 are secured to legs 33 with bolts 37 which extend through holes 39 in each end of lacings 35 and holes 41 in legs 33. In this embodiment, lacings 15 and 35 are located on the outer sides of legs 13 and 33, respectively. However, if existing tower lacings 15 were located on the inner sides of legs 13, augmentation tower lacings 35 could be fastened to the inner sides of legs 33.

Figure 2:
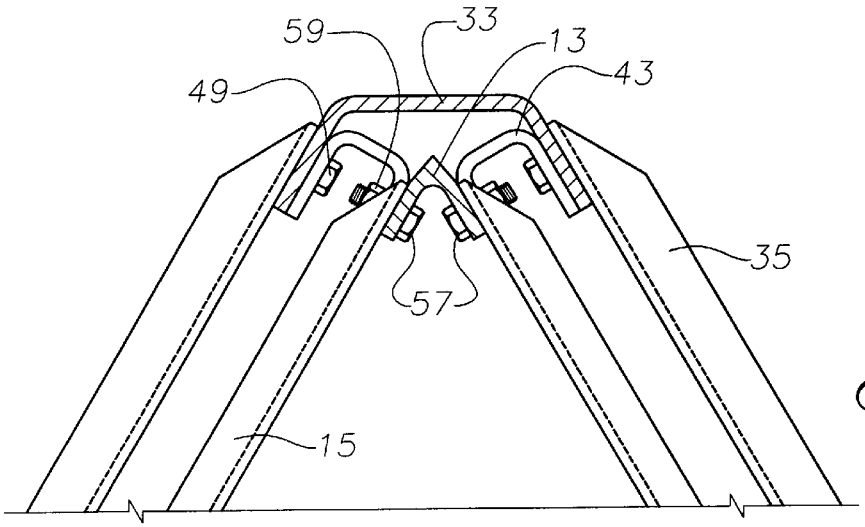
FIG. 2 is a sectional view of one leg of each of the towers of FIG. 1 after installation, and taken along the line 2—2 of FIG. 1.
Figure 3:
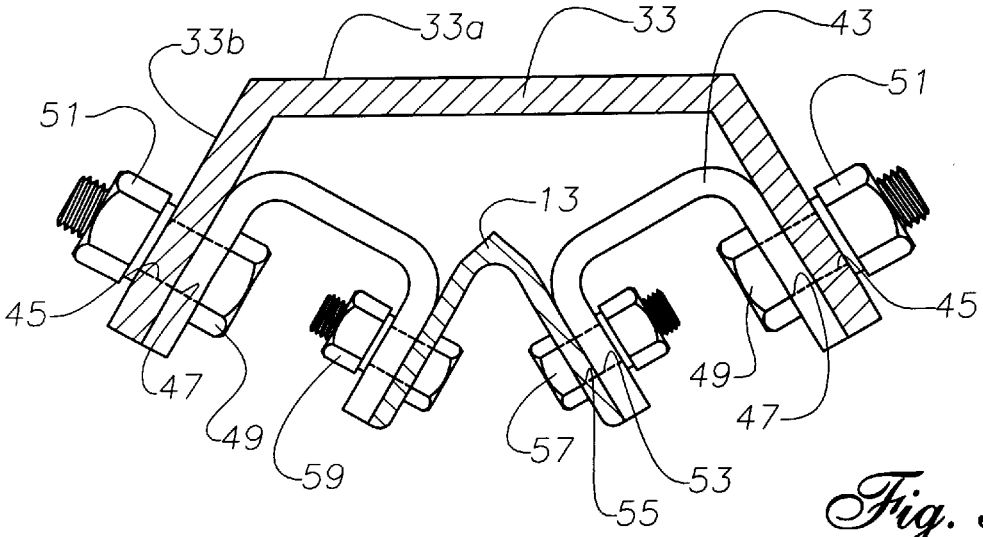
FIG. 3 is an enlarged sectional view of the leg assembly of FIG. 2 shown without tower lacing.
Figure 4:
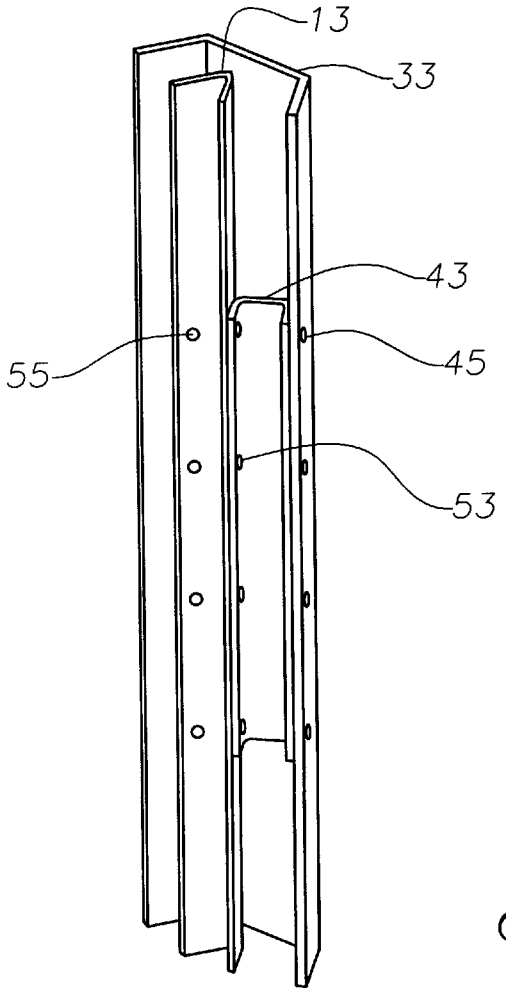
FIG. 4 is a partial isometric view of the leg assembly of FIG. 3 shown without nuts and bolts.

Referring to FIGS. 2–4, augmentation tower 31 is designed to secure to and reinforce existing tower 11. Each augmentation leg 33 has a flat base 33*a* and two flanges 33*b* which extend symmetrically away from base 33*a* at an approximately 120 degree angle. A plurality of vertically-spaced apart U-shaped channel braces 43 fasten legs 33 to legs 13. Braces 43 are relatively short pieces that are spaced apart along the lengths of legs 13, 33. Legs 33 and braces 43 have prepunched holes 45, 47, respectively, which register with one another. Bolts 49 extend through holes 45, 47 and fasten braces 43 to legs 33 with nuts 51. Braces 43 have a second set of holes 53 located on an opposite side which register with field-drilled holes 55 in existing leg 13. Bolts 57 extend through holes 53, 55 and fasten braces 43 to legs 13 with nuts 59.

Figure 5:
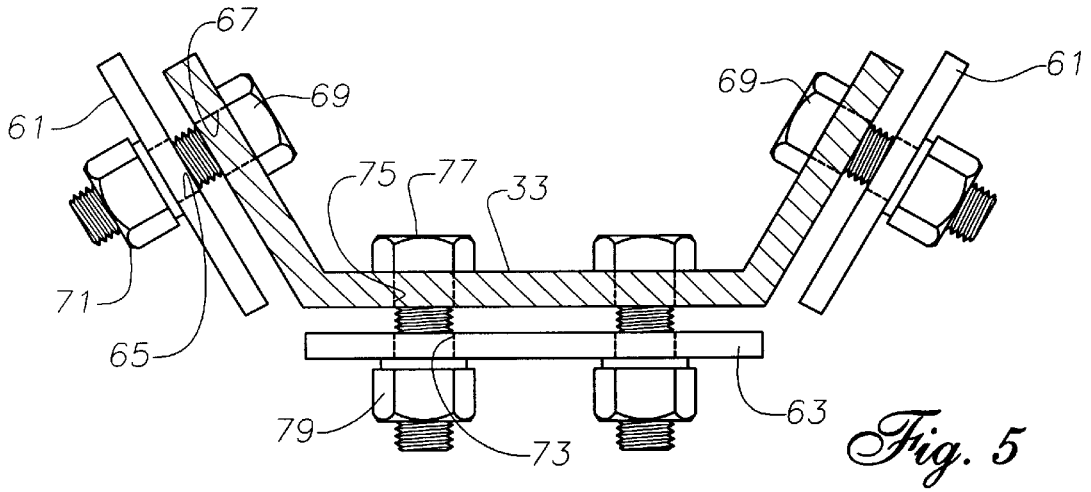
FIG. 5 is a sectional view of a splice between two sections of the augmentation tower leg of FIG. 2.

Augmentation legs 33 are made up of a plurality of sections which are typically five to twenty-five feet long. The sections of legs 33 are spliced together at upper and lower ends which abut one another. As shown in FIG. 5, each splice comprises two toe splices 61 and one heel splice 63, each of which straddles two abutting sections of legs 33. Toe splices 61 have holes 65 which register with holes 67 in two adjoining sections. Bolts 69 extend through holes 65, 67 and fasten toe splices 61 to the sections with nuts 71. Heel splices 63 have holes 73 which register with holes 75 in two adjoining sections. Bolts 77 extend through holes 73, 75 and fasten heel splices 63 to the sections with nuts 79.

Figure 6:
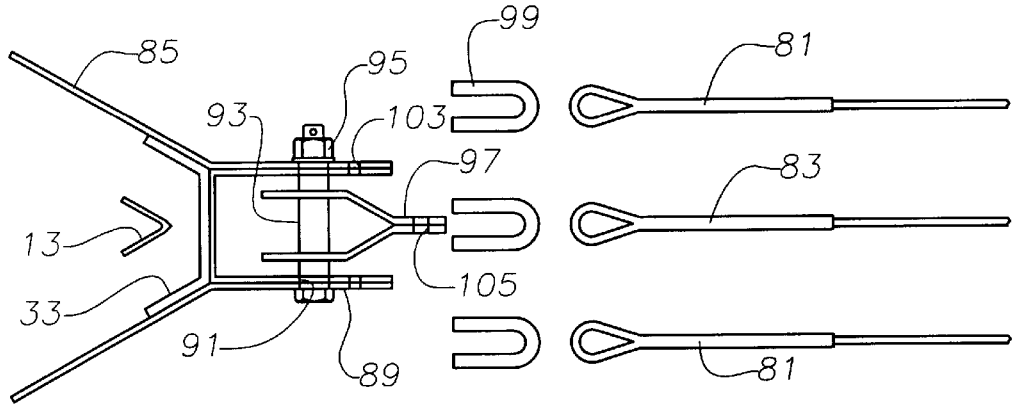
FIG. 6 is a partial, exploded top view of a guy pull-off for the leg assembly of FIG. 2.
Figure 7:
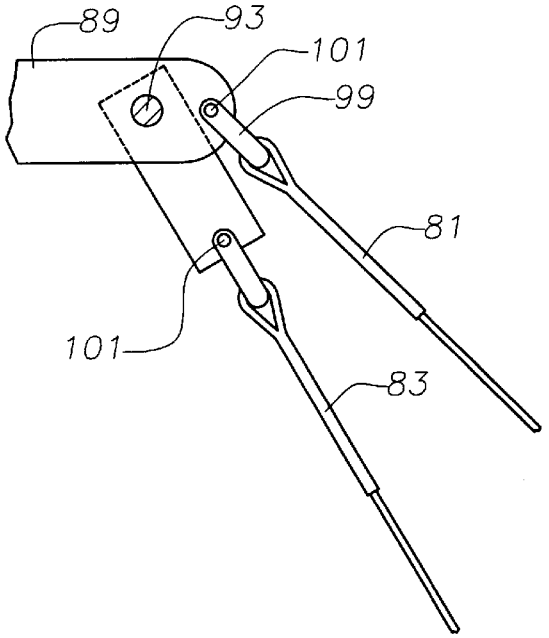
FIG. 7 is a partial side view of the guy pull-off of FIG. 6.

Referring to FIGS. 6 and 7, existing tower 11 is maintained in an upright position by a plurality of symmetrically-spaced apart, high tension guy wires 83. In an alternate embodiment (not shown), existing tower 11 may be a free-standing structure with no guy wire support. Guy wires 83 are originally secured to legs 13 and extend diagonally downward from several vertically-spaced apart points along legs 13. The distal ends of guy wires 83 are grouped in small numbers at ground level 27 (FIG. 8) where they are embedded. Augmentation tower 31 also comprises augmentation tower guy wires 81 which are designed to reinforce or replace existing tower guy wires 83. A plurality of guy wire pull-offs 85 are vertically-spaced apart along augmentation tower 31. Pull-offs 85 extend radially outward away from tower 31. Each pull-off 85 has a pair of spaced-apart collars 89 with holes 91. A bolt 93 extends through holes 91 and is secured to collars 89 with a nut 95. Bolt 93 extends through and pivotally supports a Y-shaped bracket 97 which is located between collars 89. Each guy wire 81, 83 attaches to a U-shaped shackle 99. Each shackle 99 of augmentation guy wires 81 is fastened to a collar 89 with a pin 101 which extends through a hole 103 at the distal end of collar 89. Shackle 99 of existing guy wire 83 is removed from leg 13 (FIG. 1) and fastened to bracket 97 with a pin 101 which extends through a hole 105 at the distal end of bracket 97.

Figure 8:
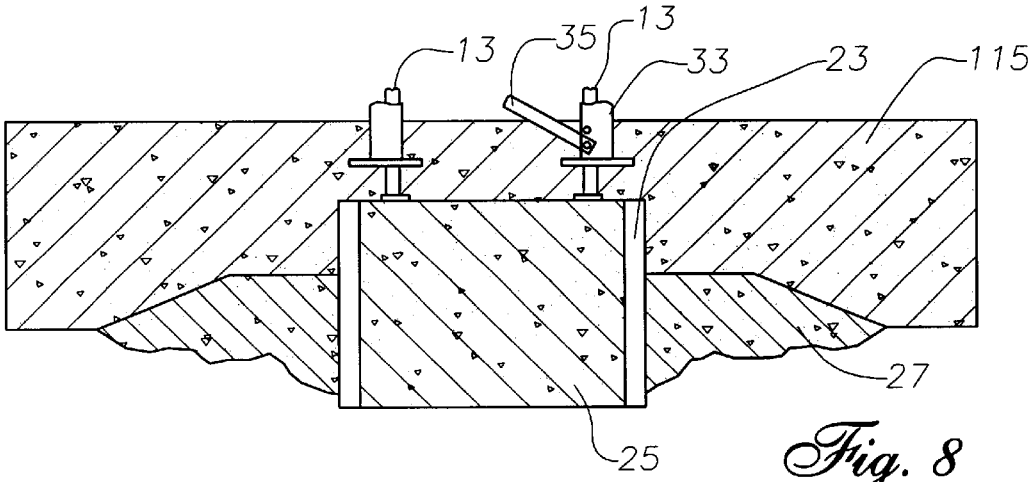
FIG. 8 is a partial sectional side view of an augmented foundation.

As shown in FIG. 8, legs 13 of existing tower 11 are secured to an existing base 23 on a lower end which is buried in an existing foundation of concrete 25 at ground level 27. When augmentation tower 31 is installed, augmentation legs 33 are embedded in a supplemental foundation of concrete 115 adjacent to existing legs 13.

In operation, augmentation tower 31 is installed on existing tower 11 like an exoskeleton and is installed from the bottom of tower 11 upward. Tower 11 is field-drilled with holes 55 for an initial section of tower 31. The initial section is secured to tower 11 as described above and supplemental foundation 115 is poured. A second section of tower 31 is spliced to an upper end of the first section and fastened to tower 11. Additional sections of tower 31 are added until a first set of existing guy wires 83 is encountered. A set of pull-offs 85 are fastened to tower 31 just below guy wires 83. Prior to disconnecting guy wires 83, a set of new augmentation wires 81 are secured to pull-offs 85. Guy wires 83 are then disconnected from tower 11, adjusted for length and secured to pull-offs 85. More sections of tower 31 are built up around and fastened to tower 11 until the top of tower 11 is reached. Each additional set of guy wires 83 are adjusted and augmented with guy wires 81. The operations of the communication antennas are not impaired during this installation. Augmentation tower 31 will have enough strength to entirely support the load. Existing tower 11 need no longer be load supporting, however, in some cases it will support some of the load in combination with augmentation tower 31.

Figure 9:
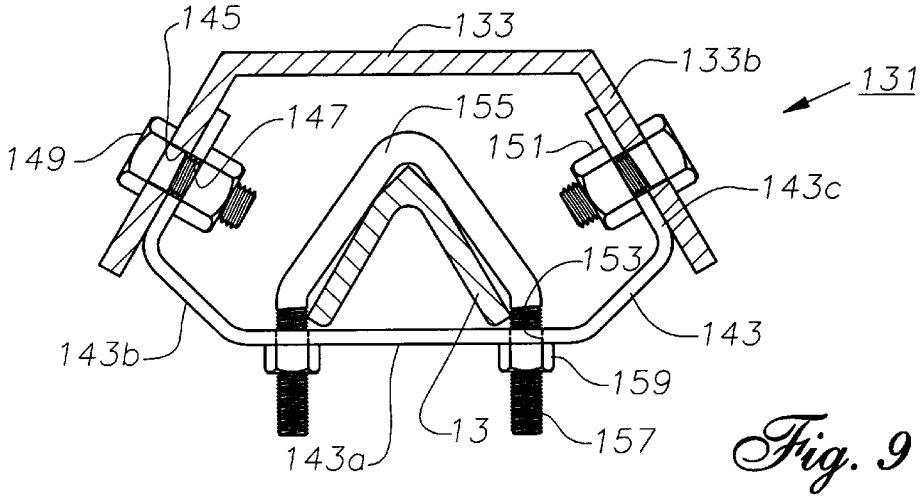
FIG. 9 is a sectional view of one leg of a second embodiment of an augmentation tower constructed in accordance with the invention.

FIG. 9 shows a second embodiment of the invention. Augmentation tower 131 is very similar to tower 31 as it is designed to secure to and reinforce existing tower 11. However, the installation of augmentation tower 131 does not require field drilling of holes in legs 13 of tower 11.

Augmentation legs 133 are secured to legs 13 with a plurality of vertically-spaced apart channel braces 143. Legs 133 are identical to legs 33. Each brace 143 extends on a side of leg 13 opposite leg 133. Each brace 143 has a base 143*a* and two flanges 143*b*. Each flange 143*b* has outer edge portion 143*c* which is bent to align with a flange 133*b*. Legs 133 and braces 143 have prepunched holes 145, 147, respectively, which register with one another. Bolts 149 extend through holes 145, 147 and fasten leg 133 to braces 143 with nuts 151. Braces 143 have a second set of holes 153 located along base 143*a* which receive the threaded ends 157 of V-shaped rods 155. Ends 157 extend through holes 153 and clamp existing leg 13 to braces 143 with nuts 159. Augmentation legs 133 are made up of a plurality of sections which are typically five to twenty-five feet long. The sections of legs 133 are spliced at upper and lower ends which abut one another as described above for legs 33.

Figure 10:
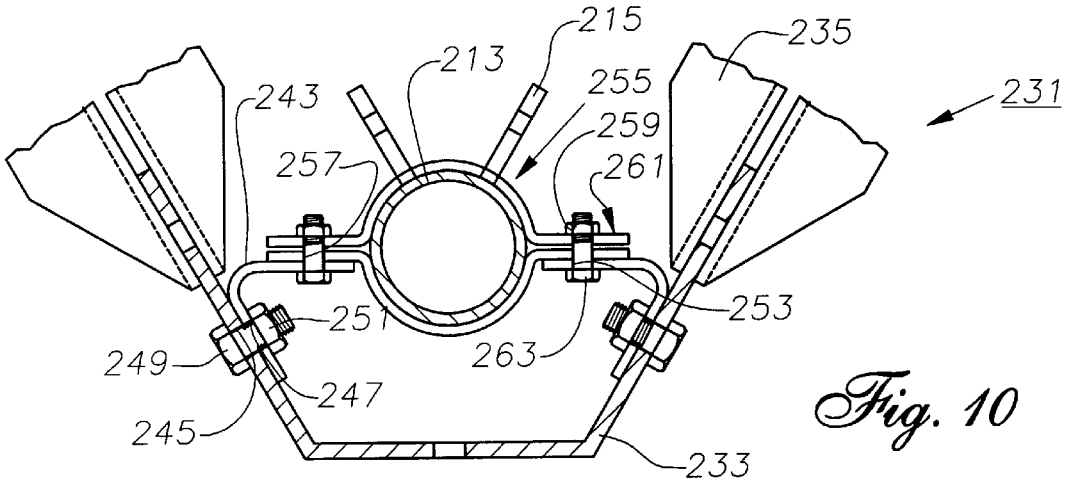
FIG. 10 is a sectional view of one leg of a third embodiment of an augmentation tower constructed in accordance with the invention.

Referring to FIG. 10, a third embodiment of the invention is shown. Augmentation tower 231 is similar to tower 131 as it is designed to noninvasively secure to and reinforce an existing communication tower. However, augmentation tower 231 is for towers with cylindrical legs 213 rather than V-shaped legs 13. Lugs 215 are attached to legs 213 and are used to attach lacing braces (not shown). Augmentation tower has legs 233 which are identical to legs 33 and 133. Legs 233 are separately fastened to one another by lacings 235. A plurality of vertically-spaced apart, V-shaped angle members or channel braces 243 attach legs 233 to legs 213. Legs 233 and braces 243 have prepunched holes 245, 247, respectively, which register with one another. Bolts 249 extend through holes 245, 247 and fasten leg 233 to braces 243 with nuts 251. Braces 243 have a second set of holes 253 located on an opposite side which register with holes 257 in flanges 261 of a circular clamp 255. Bolts 263 extend through holes 253, 257 to grip clamps 255 around existing leg 213 and are fastened with nuts 259. Augmentation legs 233 are made up of a plurality of sections which are typically twenty feet long. The sections of legs 233 are spliced together at upper and lower ends which abut one another as described above for legs 33. Ideally, the new lacings will aerodynamically align with the old lacings in each installation. If the new lacings do not align with the old lacings, stronger braces and guy wires will be required to accommodate for high wind-loads. In a light wind-load application, it may be unnecessary to align the lacings.

The invention has several advantages. It provides a cost-effective apparatus and method for reinforcing or retrofitting and existing tower rather than replacing it. The invention also may be implemented without interrupting service of the tower. In addition, an alternate embodiment is provided which noninvasively attaches the augmentation tower to the existing tower.

While the invention has been shown or described in only some of its forms, it should be apparent to those skilled in the art that it is not so limited, but is susceptible to various changes without departing from the scope of the invention.

I claim:

1. An apparatus, comprising in combination:

a first tower having a first foundation, a set of first legs extending upward from the first foundation, and a set of first lacings extending between and joining the first legs;

a second tower enclosing the first tower having a set of second legs adjacent to the set of first legs, and a set of second lacings extending between and joining the second legs; and a plurality of longitudinally spaced apart brackets extending between and joining each of the first legs to one of the second legs with the second legs being parallel to and spaced apart from the first legs for reinforcing the first tower with the second tower.

2. The apparatus of claim 1 wherein both the first tower and the second tower are supported by a single set of guy wires extending between the second legs and ground level.

3. The apparatus of claim 1 wherein each of the second legs comprises a plurality of sections which are spliced together.

4. The apparatus of claim 1 wherein the first legs are equal in number to the second legs.

5. The apparatus of claim 4, further comprising a second foundation located adjacent to the first foundation; and wherein the set of second legs extends upward from the second foundation.

6. The apparatus of claim 1 wherein each of the second legs has a flat base with two symmetrical flanges and wherein each bracket is a U-shaped channel brace which extends between one of the flanges of one of the second legs and one of the first legs.

7. The apparatus of claim 1 wherein each of the second legs has a flat base with two symmetrical flanges and wherein each of the brackets comprises a channel member which is fastened to both of the flanges of one of the second legs and clamped to one of the first legs with a clamping member.

8. The apparatus of claim 1 wherein the second legs extend from ground level and are independently supported from the first legs.

9. The apparatus of claim 1 wherein each of the first legs is cylindrical and each of the second legs has a flat base with two symmetrical flanges, and wherein each of the brackets comprises a pair of channel members which are each fastened to one of the flanges of one of the second legs and clamped to one of the first legs with a cylindrical clamping member.

10. A augmentation tower for reinforcing an existing tower having a first foundation, a set of first legs extending upward from the first foundation, and a set of first lacings extending between and joining the first legs, comprising:

a second foundation adapted to be located adjacent to the first foundation;

a set of second legs equal in number to the set of first legs and extending upward from the second foundation, each of the second legs being adapted to be adjacent and parallel to one of the first legs, each of the second legs comprising a plurality of sections which are spliced together and each of the second legs having a flat base with two symmetrical flanges;

a set of second lacings extending between and joining the second legs; and a plurality of longitudinally spaced apart brackets adapted to extend between and join the first legs to the second legs for reinforcing the existing tower with the augmentation tower.

11. The augmentation tower of claim 10 wherein the flanges of each of the second legs are at obtuse angles relative to the base.

12. The augmentation tower of claim 10 wherein each of the brackets is a U-shaped channel brace which is adapted to extend between one of the flanges of one of the second legs and one of the first legs.

13. The augmentation tower of claim 10 wherein each of the brackets comprises a channel member which is fastened to both of the flanges and extends between the flanges of one of the second legs and adapted to be clamped to one of the first legs with a clamping member.

14. The augmentation tower of claim 10 wherein each of the first legs is cylindrical and wherein each of the brackets comprises a pair of channel members which are each fastened to one of the flanges of one of the second legs and adapted to be clamped to one of the first legs with a cylindrical clamping member.

15. A method for reinforcing an existing tower having a set of first legs and a set of first lacings extending between and joining the first legs, comprising:

(a) securing a second leg to each of the first legs, the second legs being parallel to and spaced apart from the first legs; and (b) securing second lacings between the second legs.

16. The method of claim 15, further comprising the steps of:

setting a lower end of each of the second legs in a foundation such that each of the second legs is adjacent to at least one of the first legs; and joining the set of first legs to the second legs with a plurality of longitudinally spaced-apart brackets.

17. The method of claim 15 wherein the existing tower is initially supported by a set of first guy wires and wherein the method further comprises the step of attaching a set of second guy wires to the second legs and releasing the first set of guy wires from attachment to the first legs, thereby supporting both the existing tower and the second legs.

18. The method of claim 15 wherein the second legs are located outward from the first legs relative to a longitudinal axis of the existing tower.

19. The method of claim 15, further comprising the step of joining the second legs together with a set of second lacings.

20. The method of claim 15, further comprising the step of drilling holes in the first legs and securing the second legs to the first legs with brackets which are fastened in the holes.

21. The method of claim 15, further comprising the step of securing the second legs to the first legs with clamping brackets which are clamped to the first legs.

* * * * *